United States Patent [19]

Ohishi

[11] Patent Number: 4,841,419

[45] Date of Patent: Jun. 20, 1989

[54] LAMP ASSEMBLY HAVING A SNAP-ON CONNECTOR FOR READY MOUNTING AND DISMOUNTING OF A LIGHT BULB TO AND FROM A LAMP HOUSING

[75] Inventor: Kazutami Ohishi, Shizuoka, Japan

[73] Assignee: Koito Seisakusho Co., Ltd., Japan

[21] Appl. No.: 220,691

[22] Filed: Jul. 18, 1988

[30] Foreign Application Priority Data

Jul. 20, 1987 [JP] Japan ..... 62-180239

[51] Int. Cl.[4] ..... H01J 5/48

[52] U.S. Cl. ..... 362/226; 362/61; 313/318

[58] Field of Search ..... 362/226, 61, 80, 83; 313/318

[56] References Cited

U.S. PATENT DOCUMENTS

| | | | |
|---|---|---|---|
| 4,500,946 | 2/1985 | Mikola | 362/226 |
| 4,679,128 | 7/1987 | Van Duyn et al. | 362/306 |
| 4,682,274 | 7/1987 | Freudenreich | 362/61 |
| 4,747,029 | 5/1988 | Liverance et al. | 362/226 |
| 4,760,506 | 7/1988 | Mochizuki et al. | 362/226 |

*Primary Examiner*—Ira S. Lazarus
*Assistant Examiner*—Richard R. Cole
*Attorney, Agent, or Firm*—Sughrue, Mion, Zinn, Macpeak & Seas

[57] ABSTRACT

A snap-on connector is provided for readily mounting and dismounting a light bulb of the kind having a flange on its base, to and from a lamp housing in a vehicular headlamp assembly or similar lighting devices. The lamp housing has a mounting tube extending rearwardly therefrom and terminating in a bulb entrance end. Mounted on the bulb entrance end of the mounting tube in locking engagement therewith, the snap-on connector of substantially annular or tubular shape has a set of retainer lips extending radially inwardly from its end away from the lamp housing. Each retainer lip defines a space for receiving a lug on the flange of the light bulb between itself and the bulb entrance end of the mounting tube. The lugs can be slid into these spaces and locked in position by first inserting the light bulb in the bulb entrance end of the mounting tube via the snap-on connector and then by turning the light bulb in a prescribed direction relative to the mounting tube.

6 Claims, 11 Drawing Sheets

LAMP ASSEMBLY HAVING A SNAP-ON CONNECTOR FOR READY MOUNTING AND DISMOUNTING OF A LIGHT BULB TO AND FROM A LAMP HOUSING

BACKGROUND OF THE INVENTION

My invention relates generally to lighting devices and more particularly to an electric lamp assembly suitable for use as a vehicular headlamp, among other applications. Still more particularly, my invention pertains to such a lamp assembly featuring provisions for the ready mounting and dismounting of a light bulb to and from a lamp housing.

Of a variety of devices heretofore suggested and used for detachably mounting a light bulb to a lamp housing, that which is closest and most pertinent to my invention is, as far as I know, the one described and claimed in Japanese Patent Application No. 61-225315. It teaches the provision of a flange on the base of a light bulb, and of a mounting ring for securing the light bulb to a lamp housing via the flange. The light bulb is first inserted in the lamp housing through a mounting tube coaxially extending rearwardly therefrom, until the flange butts against the extremity of the mounting tube. Then the mounting ring is attached to the mounting tube thereby capturing the light bulb flange between itself and the mounting tube. The light bulb is dismountable from the lamp housing as the mounting ring is first detached from the mounting tube.

I object to this prior art device because it necessitates the handling of the mounting ring each time the light bulb is mounted to, or dismounted from, the lamp housing. The operator must manipulate the mounting ring with one hand while grasping the light bulb with the other in order to hold the light bulb flange seated against the end of the mounting tube. This necessity for the use of both hands becomes a particular inconvenience when the lamp assembly is employed as a vehicle headlight. Vehicular headlight compartments in general have no large extra space behind the headlight assembly for accommodating both hands of a serviceman. Consequently, the change of used light bulbs with new ones has heretofore been a troublesome and time-consuming procedure.

There is another reason why I object to the noted prior art device. The mounting ring must be thoroughly removed from the lamp housing for the dismounting of the light bulb from the lamp assembly. Once removed from the lamp housing, the mounting ring may be lost if the serviceman somehow diverts his attention from the mounting ring before reinstalling it.

SUMMARY OF THE INVENTION

I have hereby invented how to defeat the inconvenieces heretofore encountered in connection with lamp assemblies of the type specified and, more specifically, how to expedite the mounting and dismounting of a light bulb to and from an associated lamp housing.

Broadly, my invention may be summarized as an electric lamp assembly of the type having a light bulb including a base with a flange formed thereon, and a lamp housing for accommodating the light bulb, the lamp housing having a mounting tube extending therefrom to terminate in a bulb entrance end through which the light bulb is inserted in the lamp housing until the base of the light bulb becomes received in the mounting tube. My invention particularly concerns a snap-on connector for permitting the light bulb to be readily mounted to and dismounted from the lamp housing. The snap-on connector comprises a substantially annular or tubular body capable of being firmly mounted to the bulb entrance end of the mounting tube of the lamp housing in locking engagement therewith. The annular body is provided with a plurality of retainer lips extending radially inwardly therefrom and each defining a space for accommodating one of radial lugs on the flange of the light bulb between itself and the bulb entrance end of the mounting tube. Each retainer lip has first and second opposite ends in the circumferential direction of the annular body, at least the first circumferential end of each retainer lip being open for insertion of one lug on the light bulb flange.

Thus, for mounting the light bulb to the lamp housing, the snap-on connector may first be attached to the bulb entrance end of the mounting tube of the lamp housing in locking engagement therewith. Then the light bulb may be inserted in the bulb entrance end of the mounting tube via the snap-on connector. Then, after inserting the lugs on the light bulb flange in the open first circumferential ends of the retainer lips of the snap-on connector, the light bulb may be manually turned relative to the lamp housing until the lugs become received in the spaces between the retainer lips and the bulb entrance end of the mounting tube.

It should be appreciated that, once mounted to the mounting tube of the lamp housing, the snap-on connector in accordance with my invention need not be handled in any way during the mounting or dismounting of the light bulb to and from the lamp housing. My invention thus permits the change of light bulbs by use of one hand only. There is absolutely no possibility of the snap-on connector being lost during such change of light bulbs, the connector being left attached to the lamp housing.

I have designed the snap-on connector itself so as to permit the light bulb to snap into position on the lamp housing and to be dismounted therefrom just as easily. Further the snap-on connector can be readily mounted to the lamp housing in positive engagement therewith without use of any tool.

The above and other features and advantages of my invention and the manner of realizing them will become more apparent, and the invention itself will best be understood, from a study of the following description and appended claims, with reference had to the attached drawings showing a preferable embodiment of my invention.

DESCRIPTION OF THE PREFERRED EMBODIMENT

General

Figure 1:
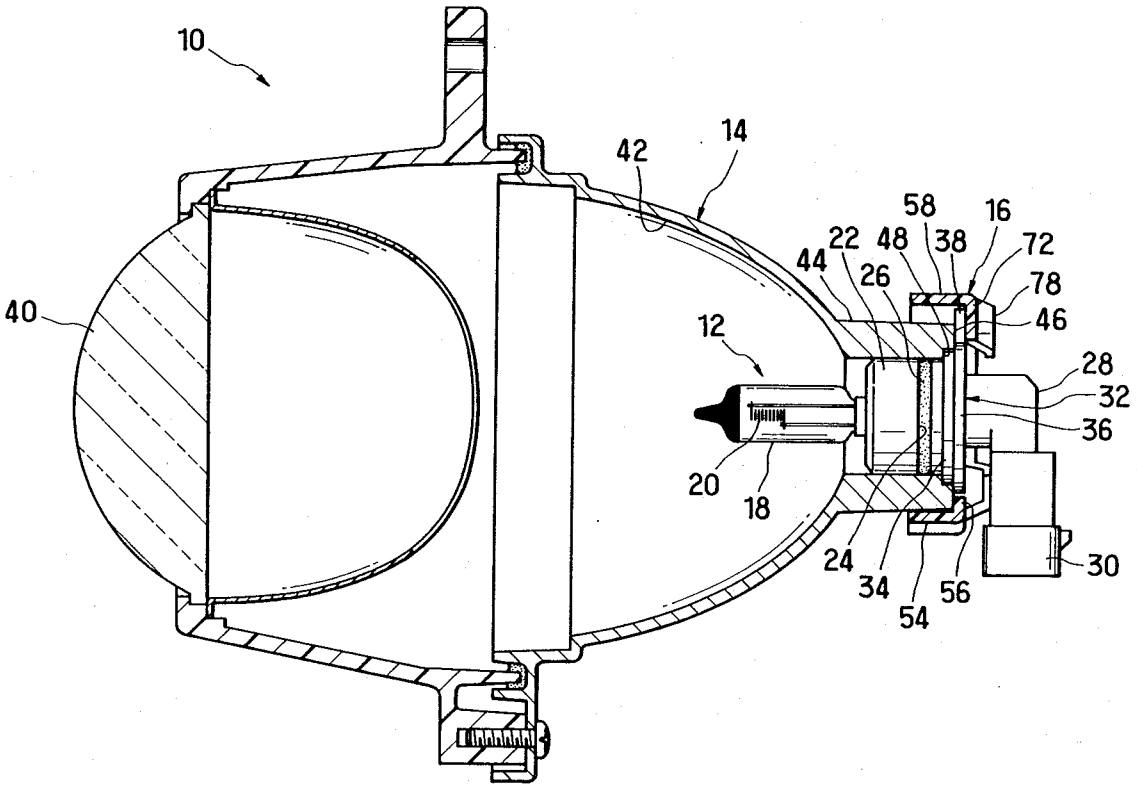
FIG. 1 is an axial section, partly in elevation, through a vehicle headlamp assembly embodying the novel concepts of my invention.
Figure 2:
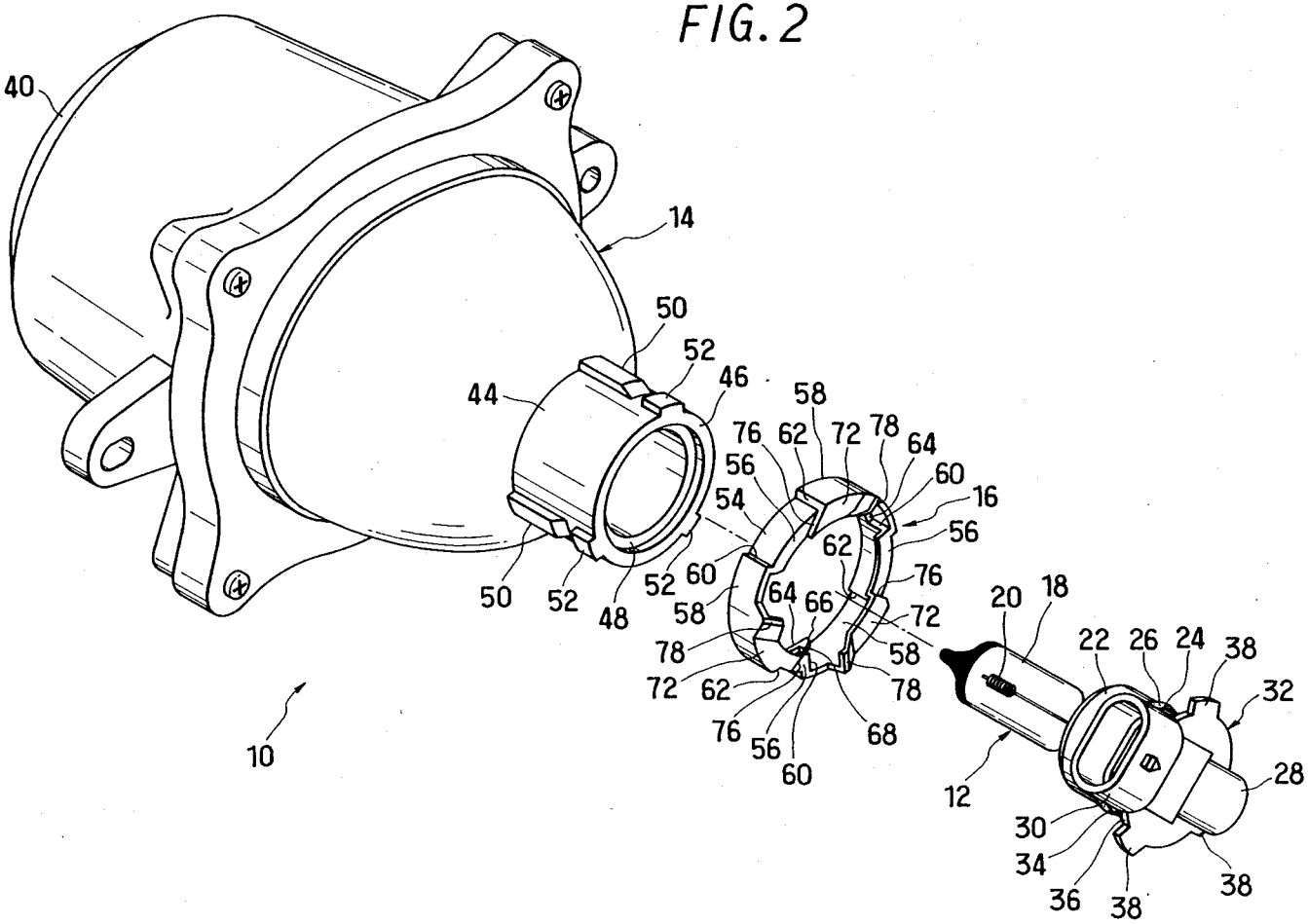
FIG. 2 is an enlarged, exploded perspective view of the headlamp assembly of FIG. 1, showing the lamp housing, snap-on connector, and light bulb of the lamp assembly in the correct positional relationship to one another.

I will now describe my invention in detail as embodied in the vehicular headlamp assembly shown assembled in FIG. 1 and exploded in FIG. 2 and therein generally labeled 10. Broadly, the headlamp assembly 10 comprises a light bulb 12, a lamp housing or body 14 and a snap-on connector 16. The light bulb 12 is mounted to, and dismounted from, the lamp housing 14 via the snap-on connector 16. My invention particularly features the snap-on connector 16, as well as its structural and functional relationship with the light bulb 12 and lamp housing 14. In assembling the three major components 12, 14 and 16 into the headlamp assembly 10, the snap-on connector 16 is to be first mounted to the lamp housing 14; then, the light bulb 12 is to be mounted to the lamp housing via the snap-on connector.

Given hereafter is a more detailed description of the light bulb 12, lamp housing 14 and snap-on connector 16, followed by the discussion of how the snap-on connector is mounted to the lamp housing, and how the light bulb is subsequently mounted to the lamp housing via the snap-on connector, under separate headings.

Light Bulb

It will be seen from FIGS. 1 and 2 that the light bulb 12 has an envelope 18 of vitreous material enclosing a filament 20 constituting the light source of the headlamp assembly 10. The envelope 18 is conventionally permanently mounted to a bulb base 22 of cylindrical shape which may be molded from a rigid plastic. An annular groove 24 is cut in the bulb base 22 for receiving an O ring seal 26. The bulb base 32 has an elbow 28 extending therefrom and terminating a socket 30.

Formed on the rear end, shown directed to the right in FIG. 1, of the bulb base 22 is a mounting flange 32 for use in mounting the light bulb 12 to the lamp housing 14 via the snap-on connector 16. The mounting flange 32 comprises a smaller diameter front portion 34 and a larger diameter rear portion 36 in this particular embodiment. The rear flange portion 36 has a plurality of, three in this embodiment, lugs 38 extending radially outwardly therefrom at prescribed circumferential spacings.

Lamp Housing

I will refer also to FIGS. 1 and 2 for the detailed description of the lamp housing 14. It is understood that the illustrated configuration of the lamp housing 14 including a lens 40 is by way of example only and should in no way be taken in a limitative sense, my invention being applicable to a variety of lamp assemblies other than this particular headlamp assembly 10. Generally, the lamp housing 14 may either be a die casing of aluminum or other metal or a molding of reinforced plastic, preferably glass fiber-reinforced plastic. A reflective layer 42 is formed on the inside surface of the lamp housing 14 as by vapor deposition of a suitable metal or by the coating of a reflective material.

Coaxially extending rearwardly from the lamp housing 14 is a mounting tube 44 which terminates in a bulb entrance end 46. The light bulb 12 is inserted, with its envelope 18 foremost, into the lamp housing 14 through the bulb entrance end 46 until the bulb base 22 becomes seated within the mounting tube 44. The noted O ring seal 26 seals the gap between bulb base 22 and mounting tube 44. An annular recess 48 is cut internally in the bulb entrance end 46 of the mounting tube 44. The smaller diameter front portion 34 of the flange 32 on the light bulb base 22 is closely engaged in this annular recess 48. The larger diameter rear portion 36 of the flange 32 is held against the bulb entrance end 46 of the mounting tube 44.

The mounting tube 44 has a plurality of, three in this embodiment, reinforcing ribs 50 formed thereon at approximately equal circumferential spacings. The circumferential spacings between the ribs 50 are not exactly alike in order to make the ribs serve as marks in mounting the light bulb 12 to the lamp housing 14 in the correct angular position about its axis. Each rib 50 extends from the front end of the mounting tube 44 in a direction parallel to its axis and terminates short of its front end.

Disposed rearwardly of each reinforcing rib 50 is a small projection 52 which is spaced in a minimal distance from the associated rib and which lies contiguous to the bulb entrance end 46 of the mounting tube 44. The snap-on connector 16 is mounted to the mounting tube 44 by engaging the projections 52 in a manner set forth hereafter.

Snap-on Connector

Figure 3:
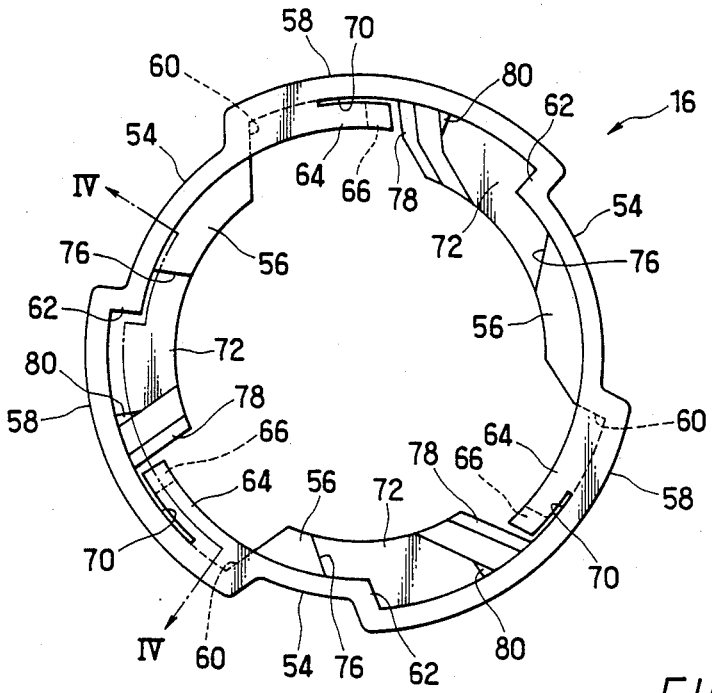
FIG. 3 is a still more enlarged end elevation of the snap-on connector, shown as seen from the front side, shown directed to the left in FIG. 1, of the lamp assembly.
Figure 4:
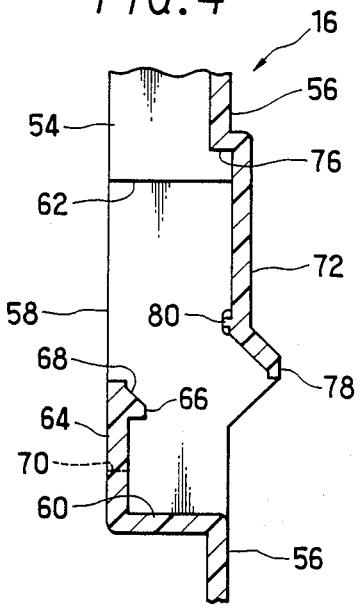
FIG. 4 is a fragmentary section through the snap-on connector, taken along the line IV—IV in FIG. 3.

The configuration of the snap-on connector 16, although very complex in shape, will nevertheless be clearly understood from FIGS. 1 and 2 taken together with FIGS. 3 and 4. I have also illustrated the snap-on connector 16 in FIGS. 5A–5C and 6A–6C in connection with the mounting tube 44, and in FIGS. 7A–7C and 8A–8C in connection with the light bulb flange 32. Reference may also be had to these drawings for the ease of understanding of the following description of the snap-on connector 16. I will, however, later refer specifically to FIGS. 5A–5C and 6A–6C for the discussion of how the snap-on connector 16 is mounted to the mounting tube 44, and to FIGS. 7A–7C and 8A–8C for the discussion of how the light bulb 12 is mounted to the mounting tube via the snap-on connector.

With particular reference to FIGS. 2 and 3 the snap-on connector 16 is an integral molding of a rigid plastic including an annular or tubular body 54 sized to fit slidably over the bulb entrance end 46 of the mounting tube 44, exclusive of its projections 52, as in FIG. 1. The annular body 54 has an inturned rim 56 on its rear end, which rim is held against the bulb entrance end 46 of the mounting tube 44.

The annular body 54 has a plurality of three in this embodiment, increased diameter portions 58 arranged at substantially constant circumferential spacings for accommodating the respective projections 52 on the lamp housing mounting tube 44 and the respective lugs 38 on the light bulb flange 32. I will refer to these increased diameter portions 58 as protuberances for simplicity.

Figure 7A:
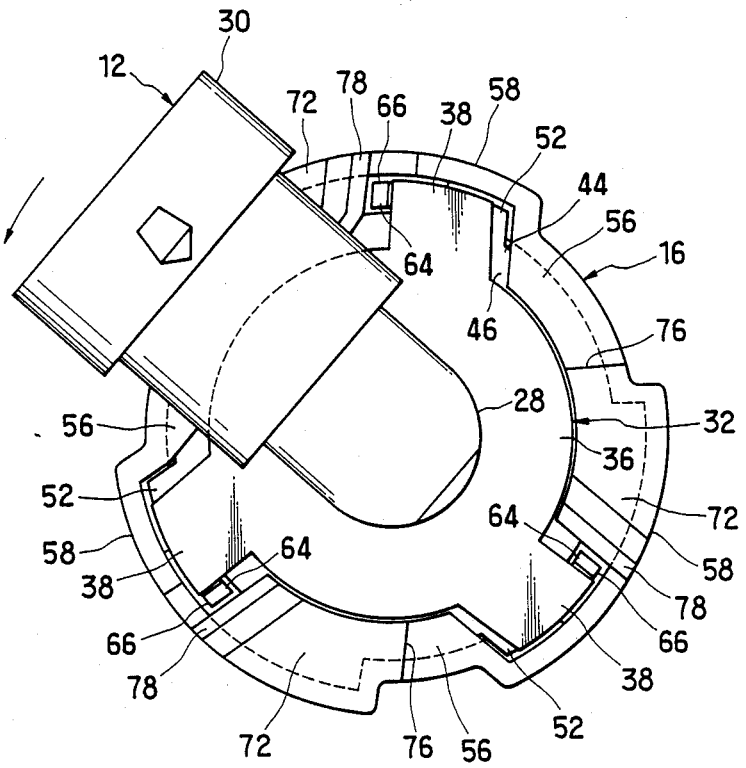
FIGS. 7A, 7B and 7C are a series of rear end elevations showing in particular the snap-on connector, which has been mounted to the lamp housing, and the light bulb, the views being explanatory of the sequential steps of mounting the light bulb to the lamp housing via the snap-on connector.
Figure 7B:
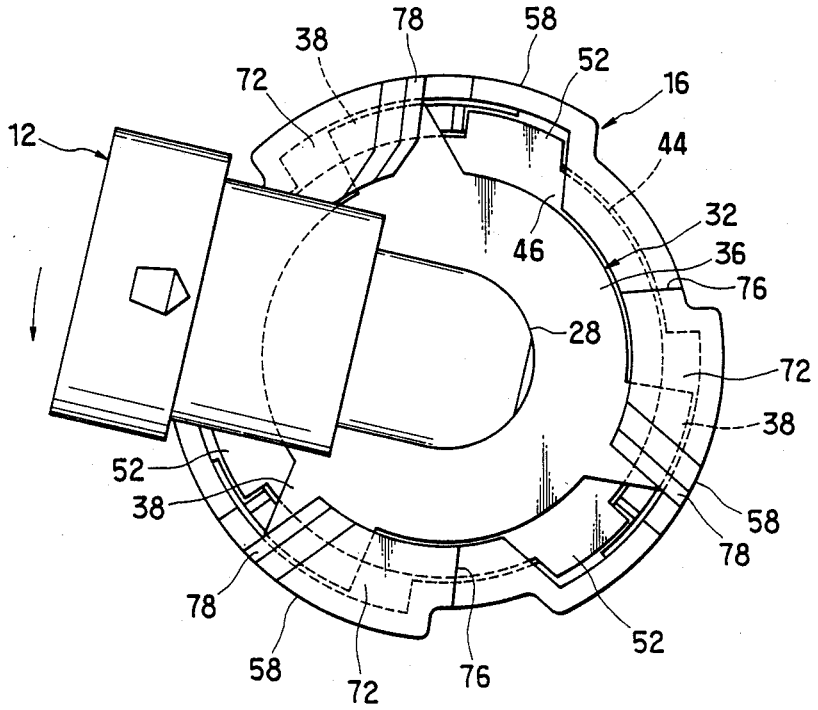
Figure 7C:
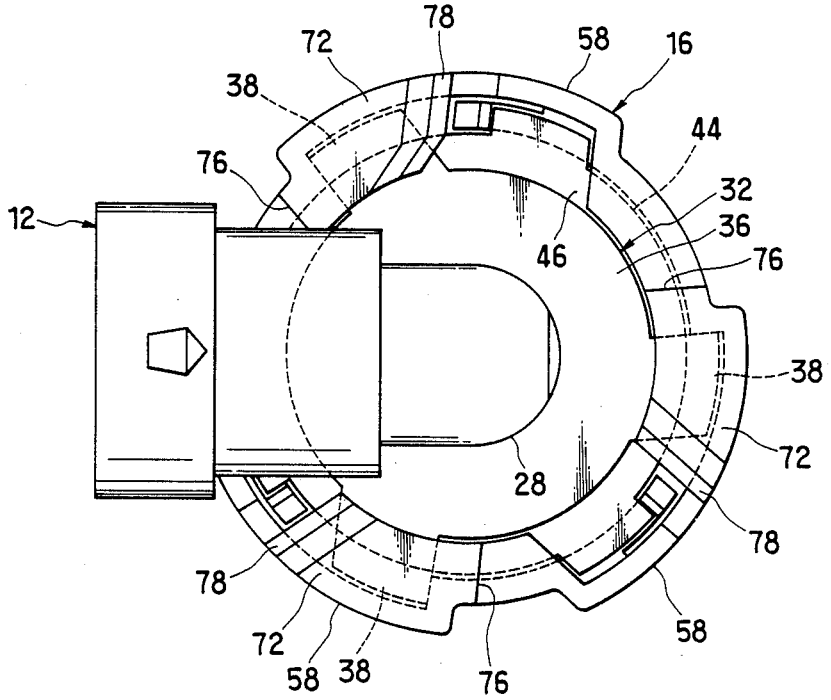

As will be understood from FIG. 3, each protuberance 58 has a pair of end walls 60 and 62 at its opposite ends in the circumferential direction of the snap-on connector 16. The internal circumferential dimension of each protuberance 58, that is, the angular spacing between its pair of end walls 60 and 62, is somewhat more than twice the circumferential dimension of each projection 52 on the lamp housing mounting tube 44 (FIGS. 5A–5C) and of each lug 23 on the light bulb flange 32 (FIGS. 7A–7C).

Figure 6A:
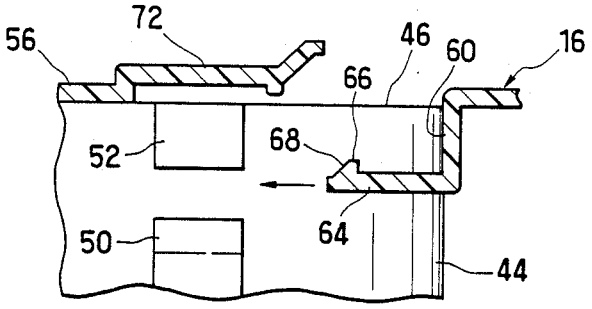
FIGS. 6A, 6B and 6C are a series of fragmentary elevations, partly in section, of the mounting tube of the lamp housing shown together with the snap-on connector thereon, these views also showing the sequential steps of mounting the snap-on connector to the lamp housing.
Figure 6B:
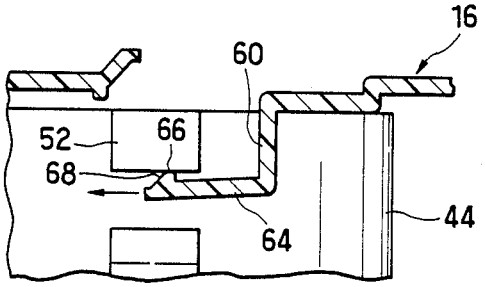
Figure 6C:
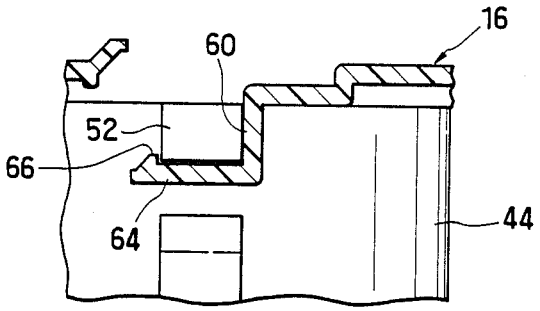

FIG. 3 also clearly indicates that three deflectable locking fingers 64 of arcuate shape are formed on the front end of the snap-on connector 16 and arranged radially inwardly of the respective protuberances 58 for locking engagement with the respective projections 52 on the lamp housing mounting tube 44. Each locking finger 64 extends circumferentially of the annular body 54 from the counterclockwise end wall 60, as viewed in FIG. 3, of one associated protuberance 58 toward its clockwise end wall 62 to an extent approximately half the circumferential dimension of the protuberance. A hook 66, FIG. 4, is formed on the distal end of each locking finger 64 for engaging one associated projection 52 on the lamp housing mounting tube 44 (FIG. 6C). Each hook 66 has a sloping surface 68 for sliding contact with one associated projection 52 in mounting the snap-on connector 16 to the lamp housing mounting tube 44 (FIGS. 6A–6C). Slits are formed at 70 to permit the deflection of the locking fingers 60 into locking engagement with the projections 52 in mounting the snap-on connector 16 to the lamp housing mounting tube 44 (FIG. 6b).

With reference directed also to FIG. 3 the spacing between the hooked end of each locking finger 64 and the opposed end wall 62 of one associated protuberance 58 is somewhat greater than the circumferential dimension of each projection 52 on the lamp housing mounting tube 44. The projections 52 are inserted through these spacings into the internal spaces of the protuberances 58 as the snap-on connector 16 is mounted to the lamp housing mounting tube 44, and are engaged by the locking fingers 64 as the snap-on connector is subsequently manually turned in a prescribed direction relative to the mounting tube (FIGS. 6A–6C). The spacing between the hook 66 on each locking finger 64 and the end wall 60 of one associated protuberance 58 is approximately equal to the circumferential dimension of each projection 52 (FIG. 6C).

I have so far dwelt mainly upon those means of the snap-on connection 16 which are needed for mounting this connection to the lamp housing mounting tube 44. The following description, then, is directed to additional means of the snap-on connector 16 which are intended for engagement with the lugs 38 on the light bulb flange 32.

Such additional means inculde a plurality of, three in this embodiment, retainer lips 72, seen in both FIGS. 2 and 3, which are formed on the rear side of the snap-on connector 16 so as to extend radially inwardly from parts of the protuberances 58. Each retainer lip 72 provides a space 74, FIGS. 8A–8C, between itself and the bulb entrance end 46 or the lamp housing mounting tube 44. The spaces 74 are for slidably receiving the lugs 38 on the light bulb, flange 32, so that I will refer to these spaces as lug spaces.

Figure 8A:
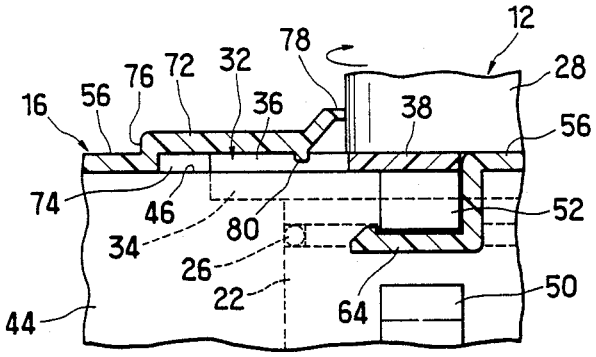
FIGS. 8A, 8B and 8C are a series of fragmentary elevations, partly in section, of the mounting tube of the lamp housing shown together with the snap-on connector and the light bulb thereon, the views being also explanatory of the sequential steps of mounting the light bulb to the lamp housing via the snap-on connector.
Figure 8B:
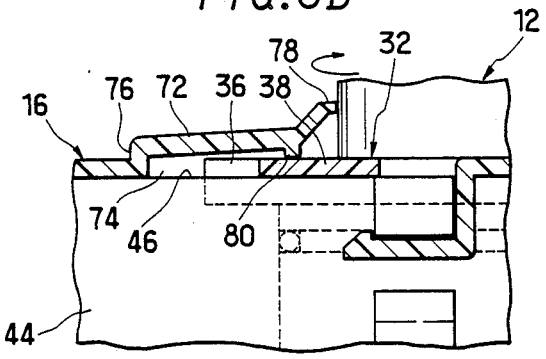
Figure 8C:
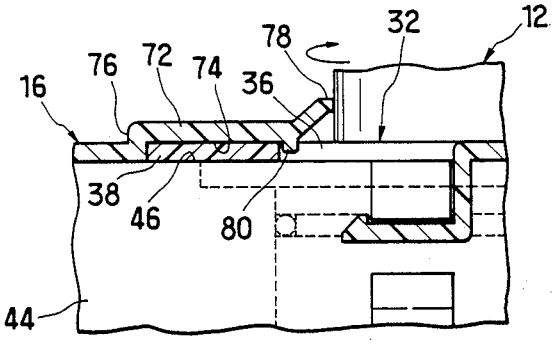

As will be understood from FIGS. 2 and 3, taken together with FIGS. 8A–8C, each lug space 74 may be thought of as having a pair of opposite ends in the circumferential direction of the snap-on connector 16. One circumferntial end of each lug space 74 is closed by an end wall 76. The other circumferential end of each lug space 74 is open for admission of one associated lug 38 on the light bulb flange 32. Bounding part of such open end of each lug space 74 is an end portion 78 of one associated retainer lip 72 which is angled rearwardly to facilitate the insertion of the associated lug 38 into the lug space 74. A locking projection 80 is formed adjacent the angled end portion 78 of each retainer lip 72 for licking engagement with the lug 38 upon full insertion thereof in the lug space 74 (FIG. 8C). The lug 38 when fully inserted in the lug space 74 comes into abutment against the end wall 76.

Mounting of Snap-on Connector to Lamp Housing

The snap-on connector 16 must be attached to the lamp housing mounting tube 44 preparatory to the mounting of the light bulb 12 to the lamp housing 14. Reference may be had to FIGS. 5a–5C and 6A–6C for a better understanding of the following description of how the snap-on connector 16 is attached to the lamp housing mounting tube 44.

Figure 5A:
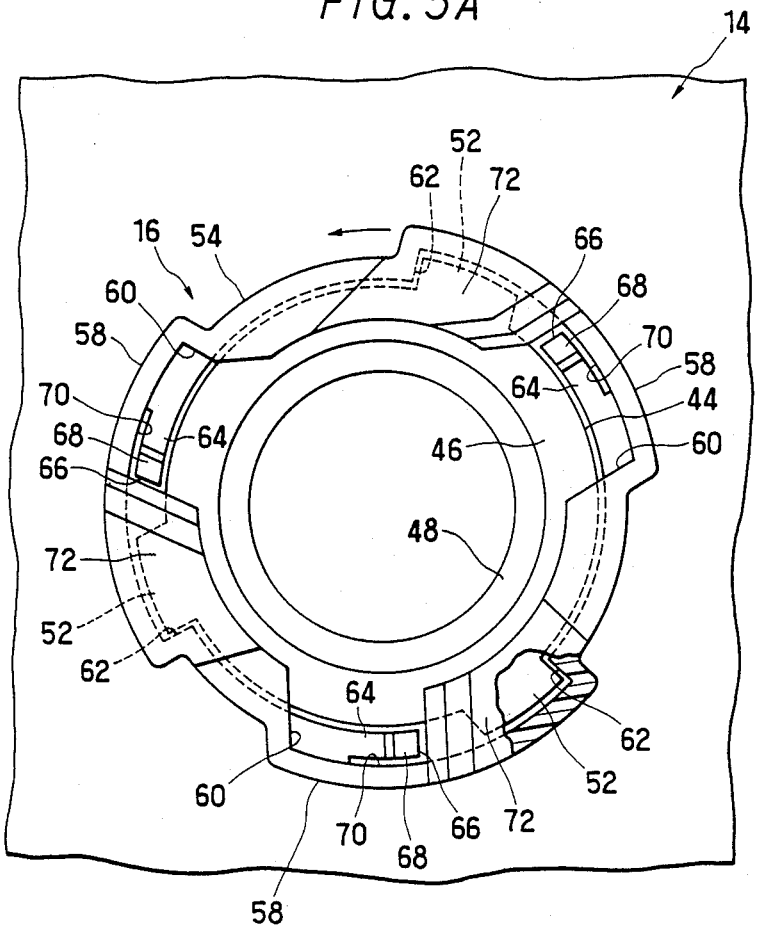
FIGS. 5A, 5B and 5C are a series of partial rear end elevations of the lamp housing and the snap-on connector, the views showing sequential steps of mounting the snap-on connector to the lamp housing.

First, as illustrated in both FIGS. 5A and 6A, the snap-on connector 16 may be fitted over the bulb entrance end 46 of the lamp housing mounting tube 44, accepting the projections 52 on the mounting tube into the enlarged spaces bounded by the protuberances 58 of the annular body 54 of the snap-on connector. I have stated that the projections 52 can be so accepted into the enlarged internal spaces of the snap-on connector 16 through the gaps between the hooked ends of the locking fingers 64 and the opposed end wall 62 of the protuberances 58. With the snap-on connector 16 so fitted over the lamp housing mounting tube 44, the inturned rims 56 of the annular body 54 of the snap-on connector will be held against the bulb entrance end 46 of the mounting tube. However, the retainer lips 72 of the snap-on connector 16 will be held away from the mounting tube end 46 to provide the spaces 74, FIGS. 8A–8C, for accepting the lugs 38 of the light bulb flange 32.

Figure 5B:
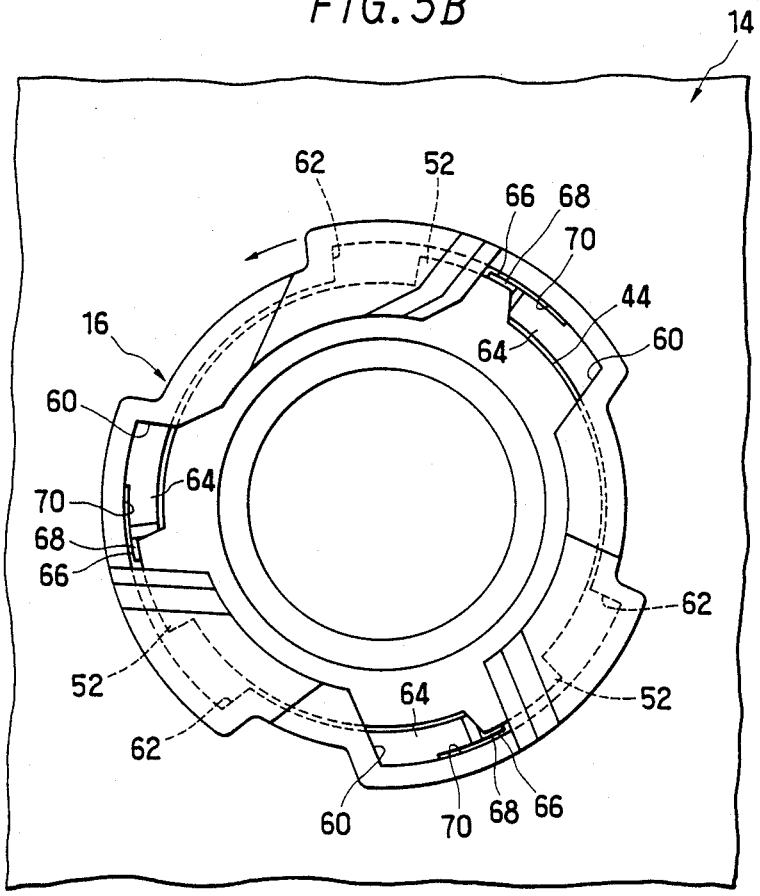

Then, as shown in both FIGS. 5B and 6B, the snap-on connector 16 may be manually turned in a counterclockwise direction, as viewed in FIG. 5B, relative to the lamp housing mounting tube 44. The hooks 66 of the locking fingers 64 will then ride onto the front edges of the projections 52 on the lamp housing mounting tube 44, as in FIG. 6B, as the sloping surfaces 68 of the hooks 66 slide over the corners of the projections 52. The locking fingers 64 will deflect forwardly of the headlamp assembly 10 while the hooks 66 are riding over the front edges of the projections 52, such deflection being permitted by the slits 70.

Figure 5C:
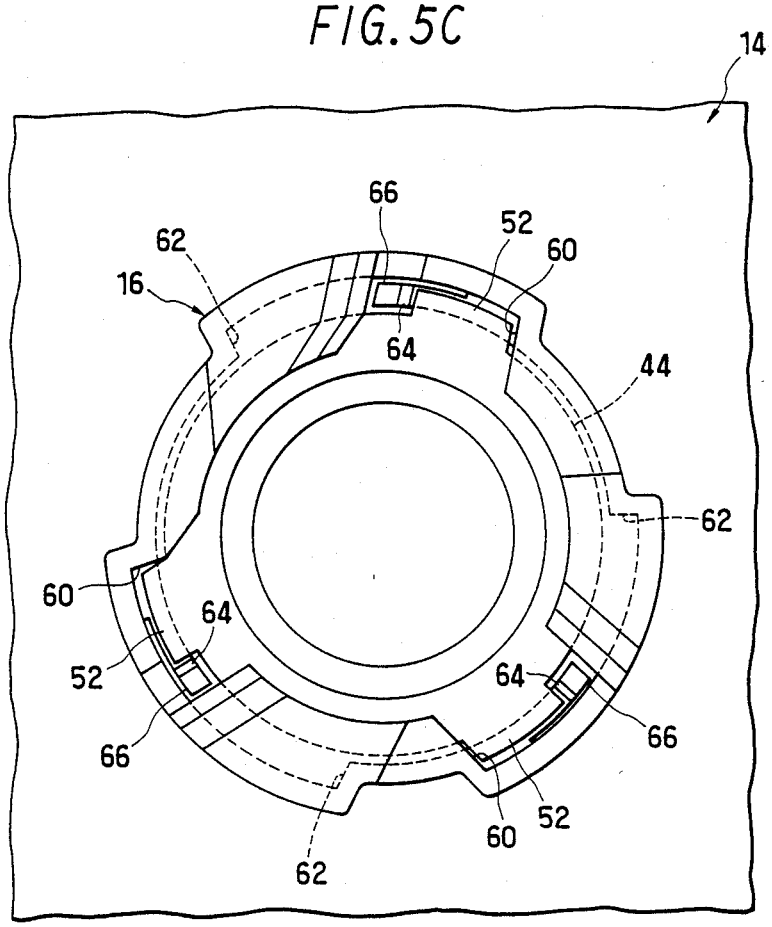

In FIGS. 5C and 6C is shown the snap-on connector 16 fully turned in the required direction, with the locking fingers 64 in locking engagement with the projections 52. It will be seen that each projection 52 is closely caught between the hook 66 of one locking finger 64 and the end wall 60 of one protuberance 58.

Now the snap-on connector 16 has been mounted to the lamp housing mounting tube 44. There is no possibility of the connector coming off the mounting tube, unless the connector is turned in a clockwise direction, as viewed in FIGS. 5A–5C, after disengaging the locking fingers 64 from the projections 52.

Mounting of Light Bulb to Lamp Housing

The light bulb 12 can now be snapped into position on the lamp housing 14 via the snap-on connector 16. I will refer principally to FIGS. 7A–7C and 8A–8C for the following description of the way in which the light bulb is mounted to the lamp housing.

The light bulb 12 may first be inserted, with its envelope 18 formost, into the lamp housing 14 through its mounting tube 44 until the lugs 38 on the light bulb flange 32 come into abutment against the snap-on connector 16 which has been mounted as above explained to the mounting tube 44. The base 22 of the light bulb 12 is now positioned within the mounting tube 44, and the o ring seal 26 on the base 22 is closely held against the inside surface of the mounting tube.

Then, with the angular position of the light bulb 12 adjusted as required about its own axis relative to the snap-on connector 16, the lugs 38 on the light bulb flange 32 may be inserted in the open circumferential ends of the lug spaces 74 defined between the bulb entrance end 46 of the lamp housing mounting tube 44 and the inturned retainer lips 72 of the snap-on connector 16. I have mentioned with reference to FIG. 8 that the open circumferential ends of the lug spaces 74 are bounded in part by the rearwardly angled end portions 78 of the retainer lips 72.

FIGS. 7A and 8A show the lugs 38 so inserted in the open ends of the lug spaces 74. The front portion 34 of the light bulb flange 32 is now engaged in the annular recess 48 in the lamp housing mounting tube 44 whereas the rear portion 36 inclusive of the lugs 38 is partly held against the bulb entrance 46 of the mounting tube.

Then, as illustrated in FIGS. 7B and 8B, the light bulb 12 may be turned in a counterclockwise direction, as viewed in FIG. 8B, relative to the lamphousing 14 and snap-on connector 16. As the lugs 38 on the light bulb flange 32 thus slide into the lug spaces 74, the retainer lips 72 will partly deflect rearwardly as the locking projections 80 thereon ride over the lugs 38.

FIGS. 7C and 8C show the light bulb 12 subsequently turned fully in the required dircetion. The lugs 38 have come into abutment against the end walls 76 forming the closed ends of the lug spaces 74 and have been locked in position by the locking projections 80 on the retainer lips 72. The mounting of the light bulb 12 to the lamp housing 14 has now been completed.

The dismounting of the light bulb 12 from the lamp housing 14 is now less easy than its mounting. The light bulb 12 may be forced to turn in a clockwise direction, as viewed in FIGS. 7A–7C, relative to the lamp housing 14. The locking projections 80 will then ride back on the lugs 38, with the consequent deflection of the retainer lips 72, as in FIG. 8B. After having been turning back to the FIGS. 7A and 8A position, the light bulb 12 may be pulled out the bulb entrance end 46 of the lamp housing mounting tube 44. There is no need for handling the snap-on connector 16 during such dismounting of the light bulb 12.

Although I have shown and described my invention in terms of but one embodiment thereof, I recognize, of course, that my invention is not to be limited by the exact details of this disclosure. Various changes may be made to conform design preferences or to the requirements of each specific application, without departing from the scope of my invention.

I claim:

1. An electric lamp assembly of the type having a light bulb including a base with a flange formed thereon, the flange having a plurality of lugs extending radially outwardly therefrom, and a lamp housing for accommodating the light bulb, the lamp housing having a mounting tube extending therefrom to terminate in a bulb entrance end through which the light bulb is inserted in the lamp housing until the base of the light bulb becomes received in the mounting tube, the mounting tube having first engagement means formed thereon, wherein the improvement resides in a snap-on connector for permitting the light bulb to bereadily mounted to and dismpunted from the lamp housing after said snap-on connector has been mounted on said mounting tube by a rotational movement of said snap-on connector, the snap-on connector comprising:

(a) a substantially annular body;

(b) locking secong engagement means formed adjacent one axial end of the annular body, the second engagement means being lockingly engageable with the first engagement means on the mounting tube of the lamp housing by rotation of said snap-on connector for lockingly mounting the annular body on the bulb entrance end of the mounting tube; and (c) a plurality of retainer lips extending radially inwardly from the other axial end of the annular body and each defining a space for accommodating one lug on the flange of the light bulb between itself and the bulb entrance end of the mounting tube, each retainer lip having first and second opposite ends in the circumferential direction of the annular body, at least the first circumferential end of each retainer lip being open for insertion of one lug on the light bulb flange;

(d) whereby the light bulb can be mounted to the lamp housing via the snap-on connector by first inserting the light bulb in the bulb entrance end of the mounting tube, then by inserting the lugs on the light bulb flange in the open first circumferential ends of the retainer lips of the snap-on connector until the lugs become held against the bulb entrance end of the mounting tube, and then by turning the light bulb relative to the lamp housing and the snap-on connector until the lugs on the light bulb flange become received in the spaces between the retainer lips of the snap-on connector and the bulb entrance end of the mounting tube.

2. The electric lamp assembly of claim 1 wherein the second circumferntial ends of the retainer lips are closed, and wherein the snap-on connector further comprises locking means formed thereon for locking the lugs on the light bulb flange against the closed second circumferential ends of the retainer lips.

3. The electric lamp assembly of claim 2 wherein the locking means comprises a locking member formed adjacent the first circumferential end of each retainer lip for engagement with one lug on the light bulb flange when the lug is moved into abutment against the second circumferential end of the retainer lip.

4. An electric lamp assembly comprising:

(a) a light bulb having a base;

(b) a flange formed on the base of the light bulb and having a plurality of lugs extending radially outwardly therefrom;

(c) a lamp housing for accommodating the light bulb;

(d) a mounting tube extending from the lamp housing and terminating in a bulb entrance end through which the light bulb is inserted in the lamp housing until the base of the light bulb becomes received in the mounting tube;

(e) a plurality of radially outward projections formed adjacent the bulb entrance end of the mounting tube at prescribed circumferential spacings; and (f) a snap-on connector for permitting the light bulb to be readily mounted to and dismounted from the lamp housing, the snap-on connector comprising:

(1) a substantially annular body fitted over the bulb entrance end of the mounting tube;

(2) a plurality of locking members formed adjacent one axial end of the annular body for locking engagement with the projections on the mounting tube, the locking members being effective to lockingly hold the annular body in position on the mounting tube upon rotation of said snap-on connector to a locking position; and

(3) a plurality of retainer lips extending radially inwardly from the other axial end of the annular body and defining a space for slidably receiving one lug on the flange of the light bulb between itself and the bulb entrance end of the mounting tube, each retainer lip having first and second opposite ends in the circumferential direction of the annular body, the first circumferential end of each retainer lip being open for insertion of one lug on the light bulb flange, the second circumferential end of each retainer lip being closed;

(g) whereby the light bulb can be mounted to the lamp housing by first mounting the snap-on connector on the bulb entrance end of the mounting tube, with the locking members of the snap-on connector in locking engagement with the projections on the mounting tube, then by inserting the light bulb in the bulb entrance end of the mounting tube via the snap-on connector, then by inserting the lugs on the light bulb flange in the open first circumferential ends of the retainer lips until the lugs become held against the bulb entrance end of the mounting tube, and then by turning the light bulb relative to the lamp housing and the snap-on connector for moving the lugs on the light bulb flange into the spaces between the retainer lips and the bulb entrance end of the mounting tube until the lugs become held against the closed second circumferential ends of the retainer lips.

5. The electric lamp assembly of claim 4 wherein each locking member of the snap-on connector is a deflectable locking finger extending circumferentally of the annular body and having a hook on one end thereof, the locking fingers with the hooks thereon being moved into locking engagement with the respective projections on the mounting tube as the snap-on connector is manually turned in a predetermined direction on the mounting tube.

6. The electric lamp assembly of claim 4 wherein the retainer lips of the snap-on connector have second locking projections formed thereon for locking engagement with the respective lugs on the light bulb flange when the lugs are moved into contact with the closed second circumferential ends of the retainer lips.

* * * * *